US008197160B2

(12) United States Patent
Stankus et al.

(10) Patent No.: US 8,197,160 B2
(45) **Date of Patent: *Jun. 12, 2012**

(54) MINE ROOF AND RIB SUPPORT WITH REINFORCED CHANNEL

(75) Inventors: John C. Stankus, Canonsburg, PA (US); Richard M. Hendrick, Beckley, WV (US)

(73) Assignee: FCI Holdings Delaware, Inc., Pittsburgh, PA (US)

( * ) Notice: Subject to any disclaimer, the term of this patent is extended or adjusted under 35 U.S.C. 154(b) by 257 days.

This patent is subject to a terminal disclaimer.

(21) Appl. No.: 12/547,904

(22) Filed: Aug. 26, 2009

(65) Prior Publication Data

US 2010/0054870 A1 Mar. 4, 2010

Related U.S. Application Data

(63) Continuation-in-part of application No. 12/023,195, filed on Jan. 31, 2008, now Pat. No. 7,794,181.

(60) Provisional application No. 60/988,889, filed on Nov. 19, 2007.

(51) Int. Cl.
*E21D 21/00* (2006.01)

(52) U.S. Cl. ..... 405/302.3; 405/288; 405/302.1

(58) Field of Classification Search ..... 405/302.1, 405/302.2, 302.3, 288; 248/235, 250, 295.11, 248/220.1, 300; 403/230, 321, 403; 52/288.1
See application file for complete search history.

(56) References Cited

U.S. PATENT DOCUMENTS

| | | | |
|---|---|---|---|
| 1,797,925 | A | 3/1931 | Plym |
| 1,946,733 | A | 2/1934 | Davis |
| 2,027,882 | A | 1/1936 | Ross |
| 2,317,634 | A | 4/1943 | Olsen |
| 2,641,029 | A | 6/1953 | Trimmer |
| 2,742,776 | A | 4/1956 | Peirce |
| 3,003,600 | A | 10/1961 | MacKenzie |
| 3,103,025 | A | 9/1963 | Gassner et al. |
| 3,415,064 | A | 12/1968 | Talobre |
| 3,485,405 | A | 12/1969 | Dement |
| 3,543,463 | A | 12/1970 | Cannon |
| 3,572,787 | A | 3/1971 | Timmerman et al. |
| 3,587,205 | A | 6/1971 | Gartside |
| 3,928,716 | A | 12/1975 | Marrero |
| 4,008,547 | A | 2/1977 | Katzman |

(Continued)

FOREIGN PATENT DOCUMENTS

| | | | |
|---|---|---|---|
| EP | 0 156 087 | A1 | 10/1985 |

(Continued)

*Primary Examiner* — Frederick L Lagman
(74) *Attorney, Agent, or Firm* — The Webb Law Firm

(57) ABSTRACT

A mine roof and rib support can be a support member having a roof support arm and a rib support arm, wherein the roof support arm is provided at an angle to the rib support arm. An aperture for a roof bolt is provided through the support member adjacent an intersection of the roof support arm and the rib support arm. A bearing plate having an upper edge and a lower edge, and a through-hole provided therebetween, can be provided wherein the upper and lower edges are positioned in abutment with the roof and rib support arms, respectively, to simultaneously apply force to each arm when a roof bolt is installed through each of the bearing plate and the support member. A flange can be provided at a distal end of one or both of the roof and rib support arms, each flange projecting toward the mine roof or rib.

20 Claims, 6 Drawing Sheets

U.S. PATENT DOCUMENTS

| | | | |
|---|---|---|---|
| 4,325,657 | A | 4/1982 | Elders |
| 4,456,405 | A | 6/1984 | Galis |
| 4,498,816 | A | 2/1985 | Korpela et al. |
| 4,513,554 | A | 4/1985 | Johnson et al. |
| 4,596,496 | A | 6/1986 | Tyrell et al. |
| 4,630,974 | A | 12/1986 | Sherman |
| 4,699,547 | A | 10/1987 | Seegmiller |
| 4,775,266 | A | 10/1988 | Seegmiller |
| 4,949,929 | A | 8/1990 | Kesselman et al. |
| 4,960,348 | A | 10/1990 | Seegmiller |
| 4,987,719 | A | 1/1991 | Goodson, Jr. |
| 5,292,209 | A | 3/1994 | Calandra, Jr. et al. |
| 5,385,433 | A | 1/1995 | Calandra, Jr. et al. |
| 5,755,535 | A | 5/1998 | Fox |
| 5,758,465 | A | 6/1998 | Logue |
| RE35,902 | E | 9/1998 | Calandra, Jr. et al. |
| 6,131,361 | A | 10/2000 | Murphy |
| 6,250,041 | B1 | 6/2001 | Seccombe |
| 6,612,087 | B2 | 9/2003 | diGirolamo et al. |
| 7,490,440 | B2 | 2/2009 | Batty |
| 7,794,181 | B2 * | 9/2010 | Hendrick ..... 405/302.3 |
| 2006/0053714 | A1 | 3/2006 | Pryor et al. |
| 2008/0283702 | A1 | 11/2008 | Ikerd |

FOREIGN PATENT DOCUMENTS

| | | | |
|---|---|---|---|
| EP | 1 081 393 | A1 | 3/2001 |
| GB | 2 043 742 | A | 10/1980 |
| JP | 06-065921 | A | 3/1994 |

* cited by examiner

FIG. 6
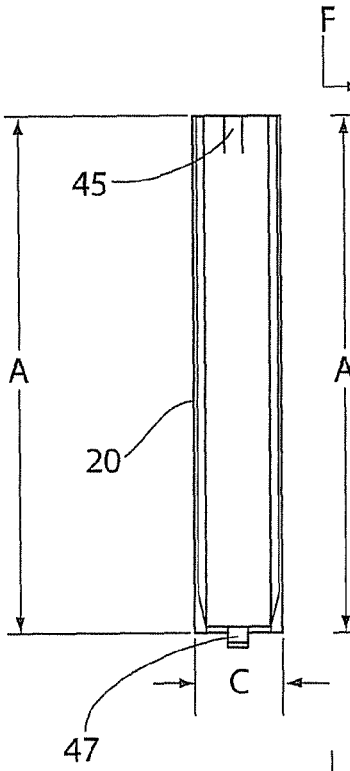
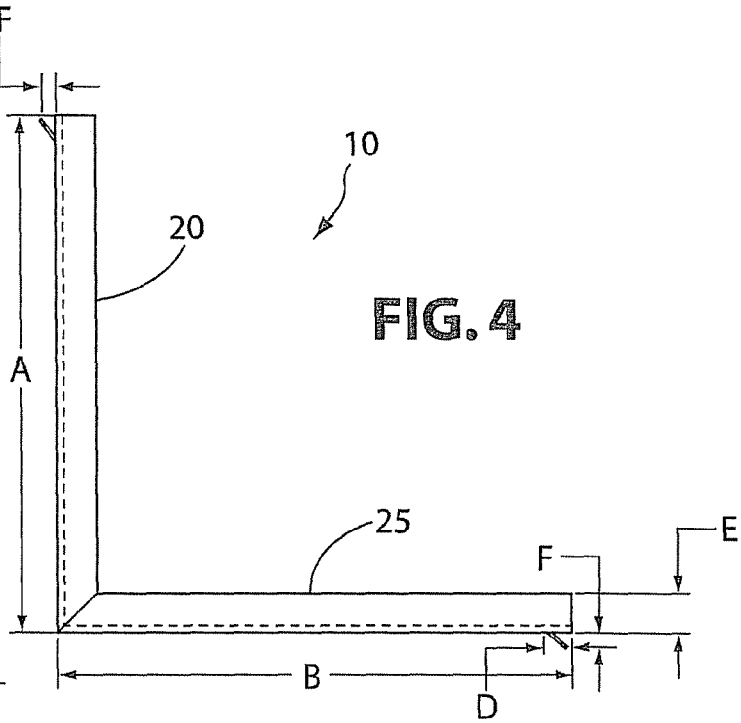
FIG. 4
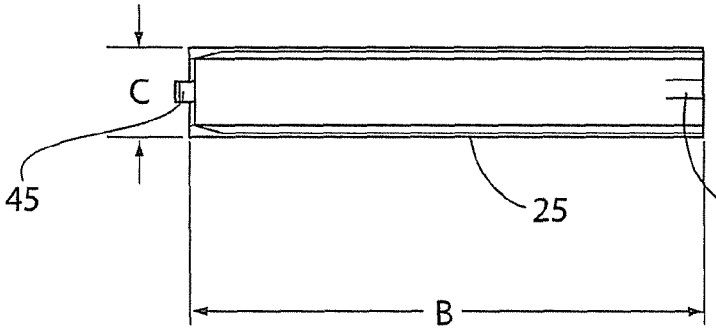
FIG. 5

MINE ROOF AND RIB SUPPORT WITH REINFORCED CHANNEL

CROSS REFERENCE TO RELATED APPLICATIONS

The present application is a continuation-in-part of U.S. patent application Ser. No. 12/023,195, filed Jan. 31, 2008, now U.S. Pat. No. 7,794,181, which claims priority to U.S. Provisional Patent Application No. 60/988,889, filed Nov. 19, 2007.

BACKGROUND OF THE INVENTION

Field Of the Invention

The support member relates generally to mine surface control, and more particularly to a mine roof and rib support with a roof support arm and a rib support arm which simultaneously support the mine roof and mine rib.

Mine roof and rib supports are commonly used in underground mining, excavating, and tunneling operations to support and control the overhead and lateral rock strata. In one conventional mine surface control system, a series of bore holes can be drilled into the mine roof or rib, a mine roof bolt can be installed in the bore hole, a channel, bearing plate, or mat can be positioned between the end of the mine roof bolt and the mine roof or rib, and the mine roof bolt can be anchored in the bore hole and tensioned such that the mine roof bolt and channel, bearing plate, or mat exert a compressive force upon the mine roof and rib to prevent deterioration of the overhead and lateral rock strata.

Some examples of mine roof and rib support systems are described in U.S. Pat. Nos. 4,456,405 to Galis entitled "Mine Roof Truss Assembly and Associated Method"; 5,385,433; 5,292,209; and RE 35,902 to Calandra, Jr. et al. entitled "Bearing Plate'; 4,960,348 to Seegmiller entitled "Truss Systems, Components, and Methods for Trussing Arched Mine Roofs"; 4,775,266 to Seegmiller entitled "Structure and Method for Deterring Cuter Roof Failure"; and 4,630,974 to Sherman entitled "Roof Support System for a Mine and Method for Providing the Same".

SUMMARY OF THE INVENTION

An embodiment of the mine roof and rib support device can generally comprise a support member having a roof support arm and a rib support arm. The roof support arm is provided at an angle to the rib support arm, and an aperture through the support member is provided for operatively receiving a mine roof bolt. The aperture can be located adjacent a junction between, or an intersection of, the roof support arm and the rib support arm. The support member can further comprise a flange provided on one, or both, of the roof support arm and the rib support arm, wherein the flange projects toward the mine roof and/or rib, respectively. The support member can be made from a metal channel having a C-shaped cross-section, and the metal channel can be bent to form each of the roof and rib support arms. The angle between the roof and rib support arms can generally be about 90 degrees to generally correspond to usual angles between the mine roof and the mine rib, but the angle can be different if needed. The flanges can be bent from the distal ends of each of the roof and rib support arms to hold the mesh that can commonly be provided between the support arm and the mine roof and/or rib.

The mine roof and rib support device can further comprise a bearing plate having an upper edge and a lower edge, a through-hole provided between said upper and lower edges, and wherein said upper and lower edges are positioned in abutment with said roof support arm and said rib support arm, respectively, when the through-hole is operatively aligned with the aperture in the support member for installation of a roof bolt through each of the bearing plate and the support member, such that the upper and lower edges apply force to the roof and rib support arms, respectively, when force is applied to the bearing plate by installation of the roof bolt. In particular, the head of the mine roof bolt, or tensioning nut, can be torqued against the bearing plate such that the upper and lower edges of the bearing plate simultaneously exert force on each of the roof support arm and the rib support arm.

To the accomplishment of the foregoing and related ends, certain illustrative aspects of the mine roof and rib support device are described in the following description and drawing figures. These aspects may be indicative of but a few of the various ways in which the principles of the mine roof and rib support device may be employed, and which is intended to include all such aspects and any equivalents thereof. Other advantages and features of the mine roof and rib support may become apparent from the following detailed description when considered in conjunction with the drawing figures.

BRIEF DESCRIPTION OF THE DRAWINGS

A more complete understanding of the mine roof and rib support can be obtained by considering the following description in conjunction with the accompanying drawing figures in which:

FIG. 4 is a front view of the support member shown in FIG. 3;

FIG. 5 is a side view of the support member shown in FIG. 4;

FIG. 6 is a bottom view of the support member shown in FIG. 4;

DESCRIPTION OF THE PREFERRED EMBODIMENTS

Figure 1:
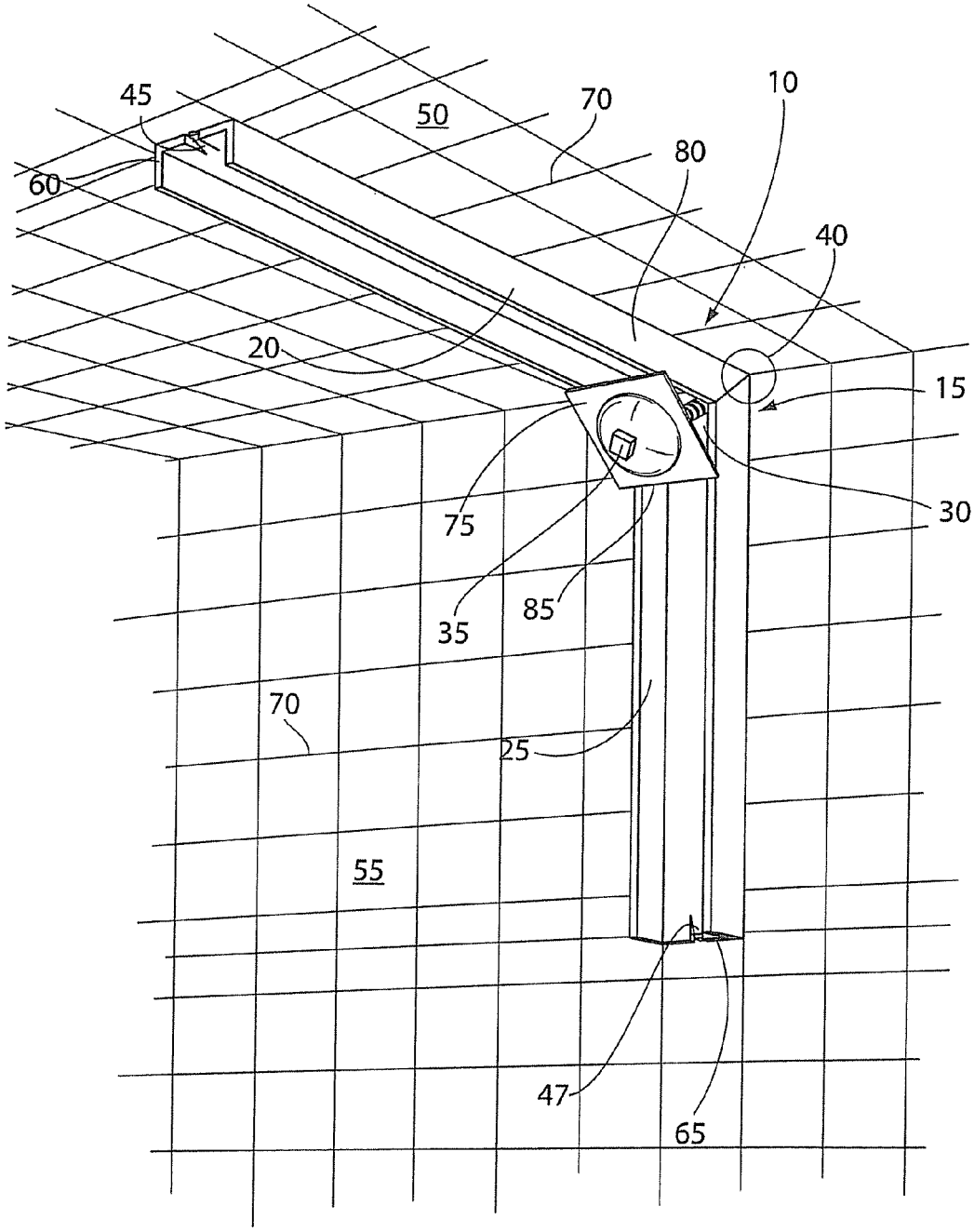
FIG. 1 is a perspective view of an embodiment of a mine roof and rib support device.
Figure 2:
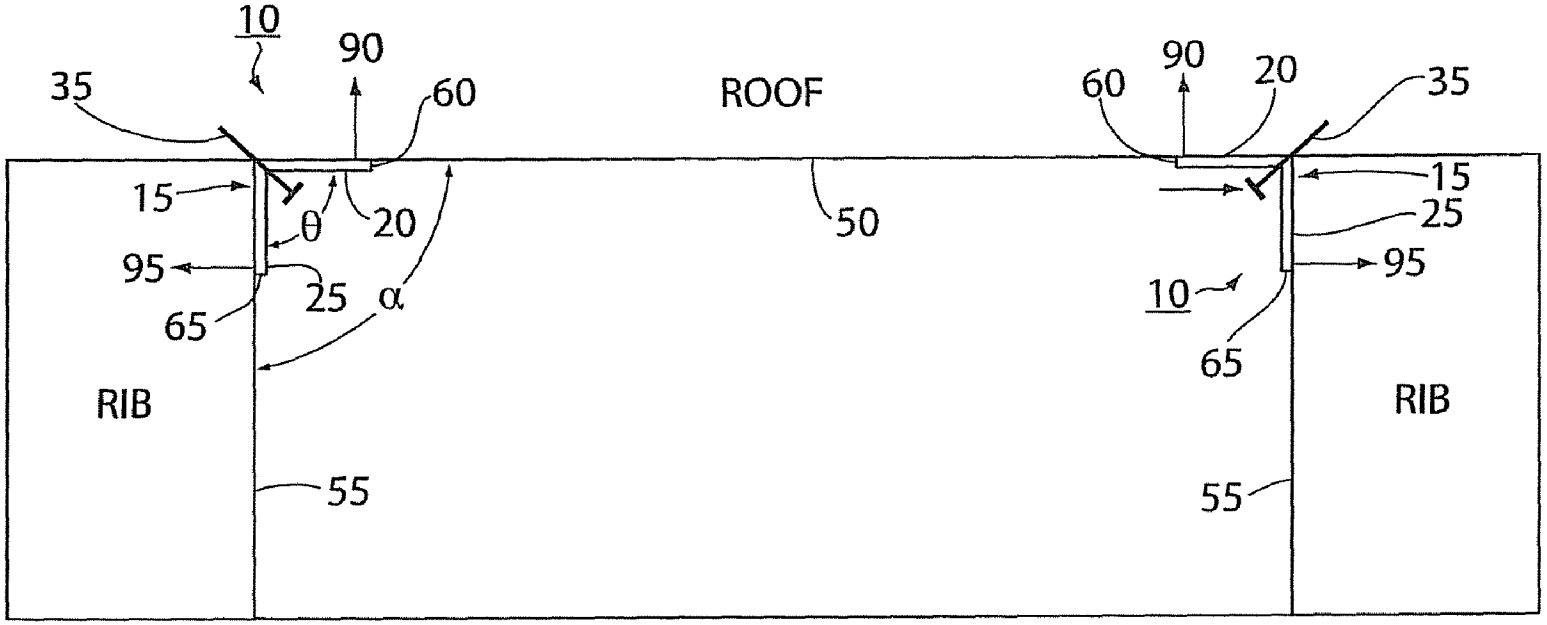
FIG. 2 is a front view illustrating embodiments of mine roof and rib support devices installed at the intersection of the mine roof and opposite sides/ribs of a mine work area.

Referring now to the drawing figures in which like reference numbers refer to like elements, a perspective view of an embodiment of a mine roof and rib support device 10 is shown in FIGS. 1 and 2, which can generally comprise a support member 15 having a roof support arm 20 and a rib support arm 25, wherein the roof support arm 20 is provided at an angle to the rib support arm 25, and an aperture 30 (shown best in FIG. 3) through the support member 15 for receiving a mine roof bolt 35, the aperture 30 located adjacent a junction between, or an intersection of, the roof support arm 20 and the rib support arm 25. The support member 15 can further comprise a flange 45 provided on one or both of the roof support arm 20 and the rib support arm 25, wherein the flange 45 projects toward a mine roof 50 or rib 55. In a further embodiment, flanges 45, 47 are provided at distal ends 60, 65 of both the roof support arm 20 and the rib support arm 25.

The angle θ between the roof 20 and rib 25 support arms can generally be about 90 degrees, since the angle α between the mine roof 50 and mine rib 55 is typically about 90 degrees. However, the angle θ between the arms 20, 25 can vary as needed, or desired, depending upon the angle between the mine roof 50 and the rib 55. Moreover, the angle α between the mine roof 50 and rib 55 may not be exactly 90 degrees, and the mine roof 50 and/or rib 55 may likely not be perfectly flat. Thus, embodiments of the support member 15 can be sufficiently flexible to compensate for variations in the angle α of the roof 50 and rib 55, and/or variations due to non-planar surfaces of the roof 50 and/or rib 55.

Figure 3:
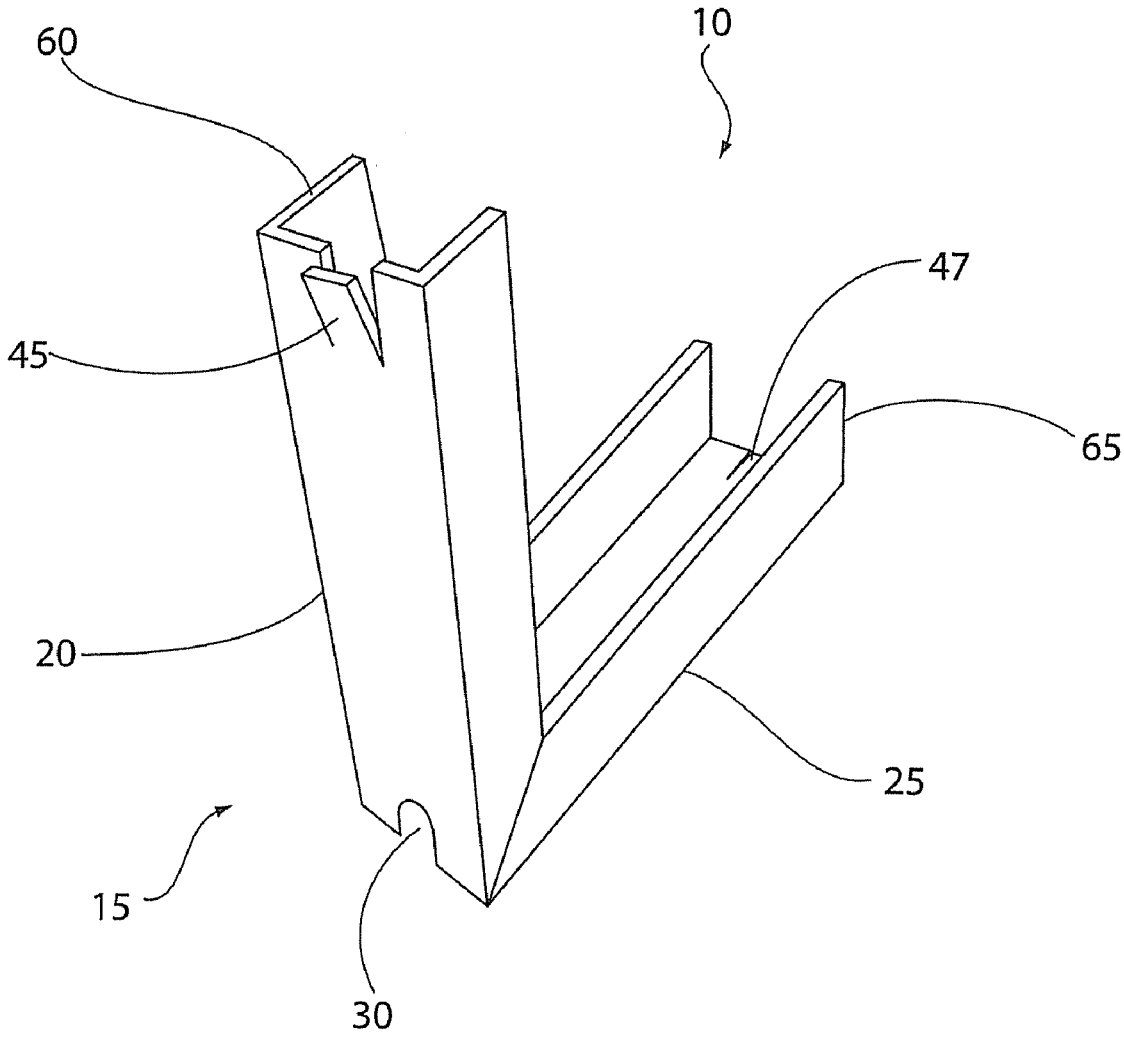
FIG. 3 is a perspective view of an embodiment of a support member of the mine roof and rib support device.

Referring to FIGS. 3 through 5, the flanges 45, 47 at the ends of the roof and rib support arms 20, 25 can be bent from the distal ends 60, 65 of each of the roof and rib support arms 20, 25. In particular, for example, portions of the distal ends 60, 65 of each arm 20, 25 can be cut away to leave a tab, or extension, which can be bent to form the flanges 45, 47. The flanges 45, 47 can be bent toward the roof 50, or rib 55, as the flanges 45, 47 are intended to hold a mat, e.g., a metal mesh 70, in cases where such mesh 70 is used in combination with the roof support arm 20 and/or rib support arm 25.

Embodiments of the mine roof and rib support device 10 can further comprise a bearing plate 75 having an upper edge 80 and a lower edge 85, and a through-hole provided between the upper and lower edges 80, 85 through which the roof bolt 35 is installed. The bearing plate 75 can be positioned adjacent the support member 15 such that the upper and lower edges 80, 85 of the bearing plate 75 are positioned in abutment with the roof and rib support arms 20, 25, respectively. When the through-hole in the bearing plate 75 is operatively aligned with the aperture 30 in the support member 15 for installation of the roof bolt 35 therethrough, the upper and lower edges 80, 85 will apply force to the roof and rib support arms 20, 25, respectively, when force is applied to the bearing plate 75 during installation of the roof bolt 35. The roof bolt 35 can be installed at a 45 degree angle, but could be installed at a different angle if desired. When the mine roof bolt 35 is torqued against the outer surface of the bearing plate 75, a compressive load is applied to the bearing plate 75. The compressive load is distributed throughout the edges of the bearing plate 75. The compressive load is transmitted from the edges of the bearing plate 75 to the roof support arm 20 and the rib support arm 25, respectively, to compress the support arms 20, 25 against the roof 50 and rib 55 of the mine tunnel. The compressive forces cause the roof support arm 20 to exert pressure against the mine roof 50 and the rib support arm 25 to exert pressure against the mine rib 55.

FIG. 2 is a plan view illustrating how the mine roof and rib support device 10 may be installed at each side of the mine tunnel. Because the bearing plate 75 can distribute the force from the roof bolt 35 to each of the roof and rib support arms 20, 25, a single roof bolt 35 can be used for each support member 15 to simultaneously provide support for both the mine roof 50 and the mine rib 55. The arrows 90, 95 in the drawing show the force vectors created by torquing the roof bolt 35 against the bearing plate 75.

FIGS. 3 through 6 illustrate further details of the support member 15, including the back surface of the support member shown in FIG. 3. As shown, the support member 15 can be made from a metal channel having a C-shaped cross-section. The metal channel can be bent to form each of the roof and rib support arms 20, 25. Each arm 20, 25 can generally be the same length, but each arm 20, 25 could have a different length if desired. Certain embodiments of the support member 15 can be made from standard four (4) inch "C" channel steel with ¼ inch back wall thickness. The side walls of the channel can be split, or notched, adjacent the bend line, i.e., where the channel will be bent to form the roof and rib support arms 20, 25 at generally 90 degrees to each other. The notch facilitates not only bending the channel to form the roof and rib support arms 20, 25, but also permits the arms 20, 25 some freedom of movement away from each other when the support member 15 is bolted to the mine roof 50. The bearing plate 75 will provide the support, similar to a brace, to resist movement of the roof and rib support arms 20, 25 towards each other subsequent to installation of the roof bolt 35. The channel can be heated to facilitate the bending process.

One manner of creating the flanges 45, 47 is to cut tabs at the distal end 60, 65, typically of both the roof and rib support arms 20, 25, and then bend the tabs outwardly, away form the back of the channel, i.e., towards the mine roof and rib 50, 55, to form the flanges, 45, 47 to engage the mesh 70 that is commonly disposed over the mine roof and rib 50, 55, under the support member 15.

In certain embodiments, the dimensions corresponding to the reference characters in FIGS. 4 through 6 can be, for example, as listed in Table 1.

TABLE 1

| Dimensions | Inches |
|---|---|
| A | 24 |
| B | 24 |
| C | 4 |
| D | 1.5 |
| E | 1.5 |
| F | 0.65 |

The exemplary embodiments shown can comprise an elongated metal structural support member having a C-shaped cross-section that will typically be bent from a single length of material, and could instead be two separate pieces of material which are, e.g., welded together.

Figure 7:
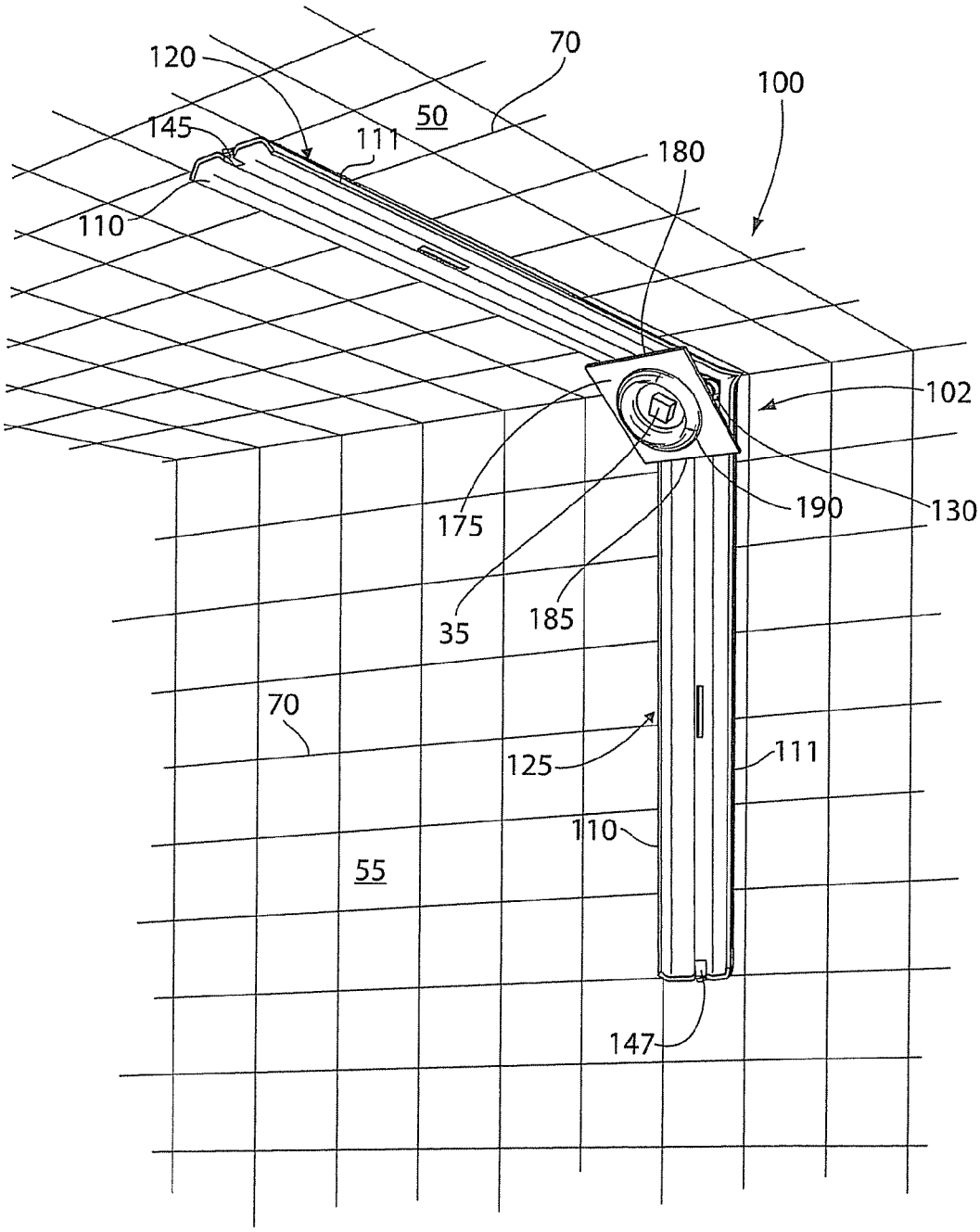
FIG. 7 is a perspective view of another embodiment of the invention.
Figure 8:
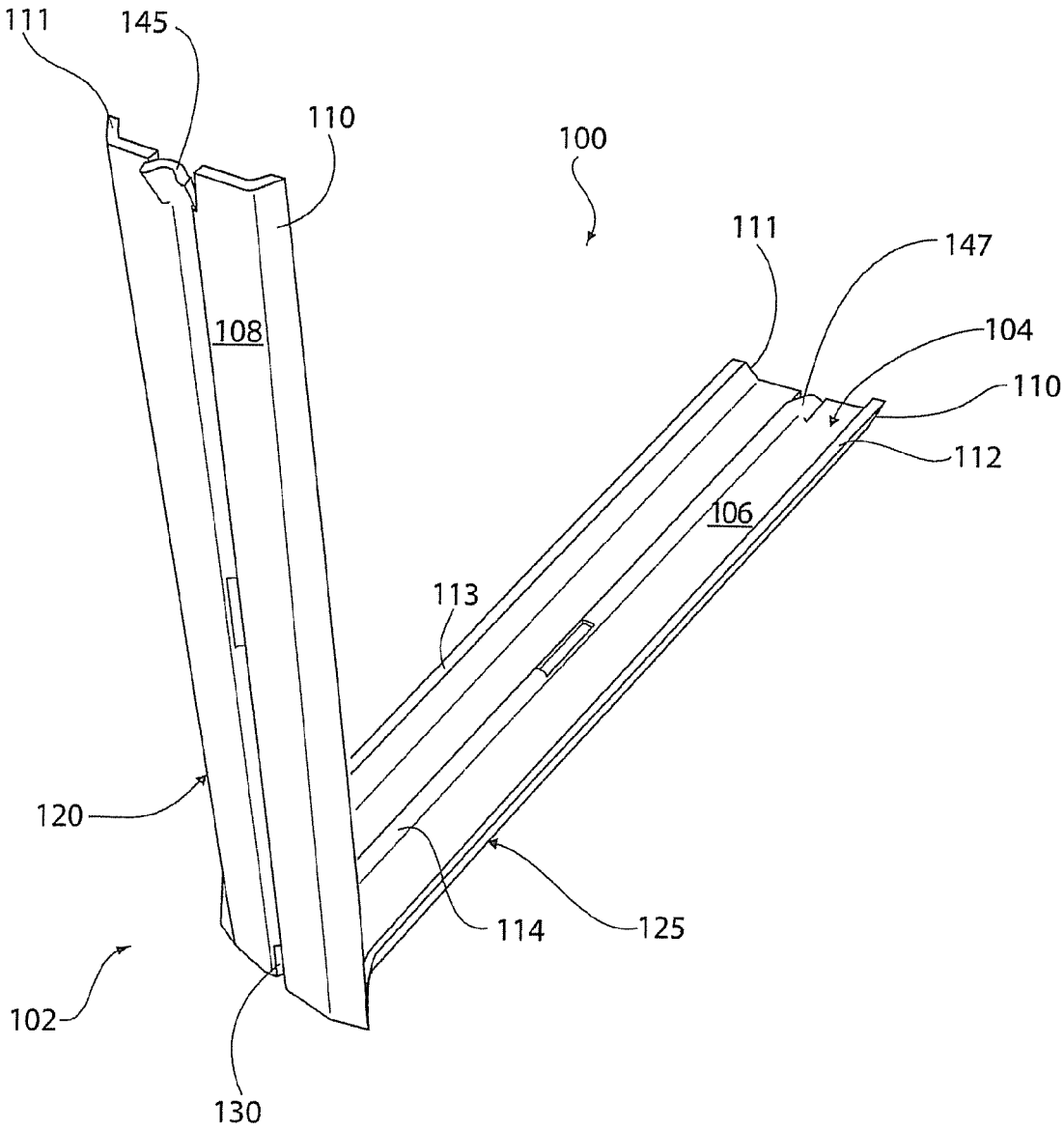
FIG. 8 is a perspective view of another embodiment of a support member.

Another embodiment of the invention is shown in FIGS. 7 and 8. Mine roof and rib support device 100 includes a support member 102 having a roof support arm 120 and a rib support arm 125, wherein the roof support arm 120 is provided at an angle to the rib support arm 125. The angle between the roof and rib support arms 120, 125 can generally be about 90 degrees. However, the angle can vary as needed, or desired as described above in regard to support member 15. An aperture 130 is defined in support member 115 for receiving a mine roof bolt 35, the aperture located adjacent a junction between, or an intersection of, the roof support arm 120 and the rib support arm 125.

Support member 102 includes a base portion 104 having a front surface 106 and a back surface 108. Integrally formed longitudinal flanges 110, 111 extend from base portion 104, such as at an angle, and terminate at respective edges 112, 113. Support member 102 further includes a reinforcement portion 114 extending from the base portion 104. Reinforcement portion 114 is illustrated as being positioned centrally on the support member 102 with aperture 130 defined therein and having a general V-shape, thereby forming a rib. The height of reinforcement portion 114 may be approximately equal to the height of longitudinal flanges 110, 111.

The mine roof and rib support device 100 may further include a bearing plate 175 having an upper edge 180 and a lower edge 185, and a through-hole provided between the upper and lower edges 180, 185 through which the roof bolt 35 is installed. Bearing plate 175 is shown as having a donut-style configuration with a reinforcing portion or embossment 190 surrounding the through-hole. The bearing plate 175 can be positioned adjacent the support member 102 such that the upper and lower edges 180, 185 of the bearing plate 175 are positioned in abutment with the roof and rib support arms 120, 125, respectively. In one embodiment, upper and lower edges 180, 185 each abut longitudinal flanges 110, 111 and reinforcement portion 114. When the through-hole in the bearing plate 75 is operatively aligned with the aperture 130 in the support member 102 for installation of the roof bolt 35 therethrough, the upper and lower edges 180, 185 will apply force to the roof and rib support arms 120, 125, respectively, when force is applied to the bearing plate 175 during installation of the roof bolt 35. The roof bolt 35 is installed at a 45 degree angle and may be installed at different angles. When the mine roof bolt 35 is tightened against the outer surface of the bearing plate 175, a compressive load is applied to the bearing plate 175. The compressive load is distributed throughout the edges of the bearing plate 175. The compressive load is transmitted from the edges of the bearing plate 175 to the roof support arm 120 and the rib support arm 125, respectively, to compress the support arms 120, 125 against the roof 50 and rib 55 of the mine tunnel. The compressive forces cause the roof support arm 120 to exert pressure against the mine roof 50 and the rib support arm 125 to exert pressure against the mine rib 55.

In one embodiment, support member 102 is produced from an elongated channel member which is bent to form roof support arm 120 and rib support arm 125. At the location of the bend, longitudinal flanges 110, 111 may become deformed as illustrated in FIGS. 7 and 8. The support member 102 may be configured to be stackable for ease of transport by including angled longitudinal flanges 110, 111, the front surface 106 of one support member 102 may receive at least a portion of a back surface 108 of another support member 102. While the entire front surface 106 of one support member 102 may not completely receive the entire back surface 108 of another support member 102, the support members may nest within each other, thereby reducing the overall footprint of multiple stacked support members as compared to multiple unstackable support members 15.

The support member 102 may include flanges 145, 147 provided on one or both of the ends of the respective roof support arm 120 and the rib support arm 125, wherein the flanges 145, 147 project toward the mine roof 50 or rib 55. A wire of mesh 70 may be positioned behind support arm 120 and over flange 145 in order to hold mesh 70 against the roof 50. Similarly, a wire of mesh 70 may be positioned behind rib support arm 125 and over flange 147 in order to hold mesh 70 against the rib 55.

As used herein, the term "upwardly" shall refer to a direction with respect to a mine passageway which is oriented generally along the direction extending from the mine floor to the mine roof, the term "downwardly" shall refer to a direction with respect to a mine passageway which is oriented generally along the direction extending from the mine roof to the mine floor, the term "outwardly" shall refer to an orientation generally in transverse direction extending from the walls of the passageway to the mine passageway central longitudinal axis, and the term "inwardly" shall refer to an orientation generally in transverse direction extending from the central longitudinal axis of the mine passageway to the walls of the passageway.

Therefore, what has been described above includes exemplary embodiments of a mine roof and rib support having a roof support arm and a rib support arm that can support both the roof and rib of the mine at the same time. It is, of course, not possible to describe every conceivable combination of components or methodologies for purposes of this description, but one of ordinary skill in the art may recognize that further combinations and permutations are possible in light of the overall teaching of this disclosure. Accordingly, the description provided herein is intended to be illustrative only, and should be considered to embrace any and all alterations, modifications, and/or variations that fall within the spirit ad scope of the appended claims.

The invention claimed is:

1. A mine roof and rib support comprising:

a support member comprising a back surface and a front surface, a base portion, an elongated reinforcement portion extending from said base portion, a roof support arm and a rib support arm, said roof support arm provided at an angle to said rib support arm; and an aperture through said support member for receiving a mine roof bolt, said aperture located at a junction between said roof support arm and said rib support arm.

2. The aperture of claim 1, wherein said support member comprises longitudinal edge portions extending angularly away from said base portion and terminating in edges.

3. The apparatus of claim 1, wherein said aperture is defined in said elongated reinforcement portion.

4. The apparatus of claim 1, wherein said elongated reinforcement portion comprises an embossment extending from said front surface.

5. The apparatus of claim 4, wherein said embossment comprises a rib.

6. The apparatus of claim 1, wherein said support member is bent to form each of said roof and rib support arms.

7. The apparatus of claim 1, further comprising a bearing plate, said bearing plate having an upper edge, a lower edge, and defining a through-hole between said upper and lower plate edges, wherein said upper and lower plate edges are positioned in abutment with said roof and rib support arms, respectively.

8. The apparatus of claim 7, wherein said bearing plate includes a raised portion in which said through-hole is defined.

9. The apparatus of claim 7, wherein said bearing plate includes a raised portion surrounding said through-hole.

10. The apparatus of claim 7, further comprising a mine roof bolt extending through said plate through-hole and said support member aperture.

11. A method of supporting a rock formation comprising:

positioning a support member with a longitudinal reinforcing portion spaced from edges of said support member against a rock formation, said support member having a first arm joined to a second arm and defining an opening intermediate said first and second arms, such that said first arm is positioned against a mine roof surface and said second arm is positioned against a mine rib surface;

positioning a bearing plate having an opening against said support member so that said support member opening is aligned with said plate opening; and extending a mine roof bolt through said plate opening and said support member opening into engagement with a rock formation to compress said bearing plate against said support member to maintain said support member in contact with the rock formation.

12. The method of claim 11, further comprising: compressing said bearing plate against at least one of said support member reinforcing portion and said support member edges.

13. The method of claim 12, wherein said support member includes a base portion from which said reinforcing portion extends and longitudinal edge portions extending angularly away from said base portion and terminating in said support member edges.

14. The method of claim 11, further comprising providing an embossment in said bearing plate.

15. The method of claim 11, further comprising positioning a mesh mat between the rock formation and the support member such that the support member contacts the mesh mat to maintain the mesh mat in contact with the rock formation.

16. A stackable mine roof and rib support member comprising:

a one-piece elongated member comprising a roof arm and a rib arm, said roof arm provided at an angle to said rib arm such that said roof arm and said rib arm are connected via a bent portion, said bent portion defining an opening for receiving a mine roof bolt therethrough;

said elongated member having a back surface and a front surface, a base portion, an elongated reinforcement portion extending from said base portion; and longitudinal edge portions extending angularly away from said base portion and terminating in edges, whereby said front surface of support member is configured to receive a back surface of another of said support member in overlying and abutting relationship.

17. The support member of claim 16, wherein said reinforcement portion comprises an embossment extending from said front surface.

18. The support member of claim 17, wherein said embossment comprises a rib.

19. The support member of claim 18, wherein said support member has a maximum thickness of 0.2 inches.

20. The support member of claim 16, further comprising a flange provided on at least one of said roof and rib arms, said flange extending in a direction opposite to said reinforcement portion.

* * * * *